US006358410B1

(12) United States Patent
Lambert

(10) Patent No.: US 6,358,410 B1
(45) Date of Patent: Mar. 19, 2002

(54) POOL SKIMMER WITH BUOYANT MEMBER

(76) Inventor: Jeffrey W. Lambert, 1571 Greyson Ridge, Marietta, GA (US) 30062

( * ) Notice: Subject to any disclaimer, the term of this patent is extended or adjusted under 35 U.S.C. 154(b) by 0 days.

(21) Appl. No.: 09/772,153

(22) Filed: Jan. 30, 2001

(51) Int. Cl.[7] ..... E04H 4/16

(52) U.S. Cl. ..... 210/169; 210/232; 210/238; 210/242.1; 4/496

(58) Field of Search ..... 210/169, 232, 210/238, 242.1, 470, 471; 4/496, 490

(56) References Cited

U.S. PATENT DOCUMENTS

| | | | | |
|---|---|---|---|---|
| 2,989,185 | A | * | 6/1961 | Lombardi |
| 3,931,740 | A | | 1/1976 | Carter |
| 4,089,074 | A | | 5/1978 | Sermons |
| 4,369,109 | A | * | 1/1983 | Edge |
| 4,481,117 | A | | 11/1984 | Collins |
| 5,173,181 | A | | 12/1992 | McFarland |
| 5,288,414 | A | | 2/1994 | Mongiello |
| 5,422,001 | A | | 6/1995 | Yagoda et al. |
| 5,614,085 | A | | 3/1997 | Platt, III |
| 5,705,058 | A | * | 1/1998 | Fischer |
| 5,849,184 | A | * | 12/1998 | Veillet |
| 5,858,211 | A | * | 1/1999 | Conrad |
| 5,911,878 | A | | 6/1999 | Benvenuto et al. |
| 5,951,858 | A | * | 9/1999 | Soto et al. |
| 6,063,270 | A | * | 5/2000 | d'Offay |

* cited by examiner

*Primary Examiner*—David A. Simmons
*Assistant Examiner*—Fred Prince
(74) *Attorney, Agent, or Firm*—William B. Noll

(57) ABSTRACT

A buoyant, pool skimming device for removing floating debris from swimming pools. The device includes a skimmer frame mounting plural flotation, buoyancy members removably secured to the frame. The respective members each comprise an elongated elastomeric member, having a snap engaging channel for attachment to the frame, and a light weight foam body secured thereabout.

6 Claims, 2 Drawing Sheets

POOL SKIMMER WITH BUOYANT MEMBER

FIELD OF THE INVENTION

This invention is directed to the field of surface skimming devices for pools, more particularly to a pool skimming device that includes buoyancy members or components to facilitate surface skimming of pools.

BACKGROUND OF THE INVENTION

The present invention relates to a skimming device for removing leaves and other debris from the surface of swimming pools, where the device incorporates buoyancy means to assist the user in the removal of debris, etc.

Swimming pools, typically outdoors and uncovered, often collect a variety of debris such as leaves, twigs, insects, etc. Such debris is generally airborne and may initially float on the surface of the swimming pool, while other debris falls to the pool bottom. This floating and submerged debris is highly undesirable to swimmers, and generally detracts from the aesthetic value and appearance of the pool.

A number of devices have been developed in the art for dealing with pool debris. On the most basic level, debris can be removed from the surface of the pool water through the use of a net on the end of a pole. These manual skimmers are labor-intensive and do not provide a continuous skimming of the surface; that is, they are effective only when manually used to remove debris. While some debris may be removed by filters in association with the pump which circulates the pool water; these types of filters are actually designed more to protect the pump from clogging as a result of a buildup of debris than for providing an efficient means for cleaning the pool water.

Thus, it is clear that pool owners have recognized the need for means to assist in the removal of debris from pools. Further, such means in current use are both manually operated and automatic systems, where the latter rely primarily on the pool's recirculating skimming system. Several of the patented skimming means are reflected in the following U S. Patents:

a.) U.S. Pat. No. 5,911,878, to Benvenuto et al., teaches a passive pool skimmer having a T-shaped buoyant stabilizer end and a flexible strap which provides a readily displaceable structure that removes debris from the surface of a pool. The pool skimmer includes a rectangular frame having a net attached thereto in the configuration of a rectangular pouch. At one end of the frame, two floats are attached to the ends of a T-shaped structure. The floats rest against the side of the pool and, in combination with a float at the opposite end of the frame, provides sufficient buoyancy to substantially center the opening of the frame at the water level. A flexible strap with a quick disconnect is attached to the skimmer and allows relative motion of the pool skimmer.

b.) U.S. Pat. No. 5,614,085, to Platt, III, relates to an omnidirectional skimmer for removing debris from the surface of a liquid and include a first flotation member, a second flotation member, first and second hollow cross-members and a net operatively connected to the first and second hollow cross-members. The first and second hollow cross-members have open ends such that in operation one of the cross-members is submerged in water and therefore filled with water, while the other cross-member is above the surface of the water and therefore empty. The hollow open cross-members and an omnidirectional pulling element allow the pool skimmer to be operated in any direction regardless of orientation. For example, the pool skimmer can be flipped over and still operated, or the net of the pool skimmer can be inverted while the pool skimmer maintains operational effectiveness.

c.) U.S. Pat. No. 5,422,001, to Yagoda et al., is directed to an enlarged pool skimmer with a buoyancy component including a frame. The frame is formed of an upper horizontal tube in an inverted U-shaped configuration with downwardly extending ends and a lower angled tube in a U-shaped configuration with upwardly extending ends and with vertically extending brackets coupling the ends of the tubes at an outboard side and an inboard side. The brackets are formed with longitudinal slots extending vertically over the majority of the central extent of the brackets. A cylindrical pipe is positionable in a horizontal orientation with supports at the opposite ends thereof for adjustably coupling the ends of the pipe to the slots of the brackets. Also included are bolts and associated nuts which extend through the brackets at the ends of the pipe to allow for vertical adjustment of the pipe with respect to the frame. A fine mesh screen is formed of a plastic material covering the space between the upper tube, the lower tube and the side brackets.

d.) U.S. Pat. No. 5,288,414, to Mongiello, covers a pool skimming device secured to the peripheral structure of a pool so having a hoop and net situated in the path of the water surface current caused by the water input of a pool's circulation system.

e.) U.S. Pat. No. 4,481,117, to Collins, teaches a swimming pool cleaning apparatus comprising a quick connect-disconnect handle, an ovate frame, a collecting net structure with an inner and outer section, and a blade-like edge on the forward portion of the frame. The collecting net structure contains an open inner net contained in a closed outer net; the inner net allows easy ingress of debris into the outer net while retarding its escape if the direction of net motion is reversed. The blade-like edge of moderately flexible material attached to the front of the net increases the efficiency of collection of debris close to the bottom walls of the pool. Construction of the apparatus is modular and allows easy replacement of worn parts without discarding serviceable parts; repairs can be made without the use of tools. The ease of assembly and disassembly allows the net to be stored and shipped in a disassembled state and is reflected in reduced handling costs.

f.) U.S. Pat. No. 4,089,074, to Sermons, relates to a leaf skimmer for swimming pools having a floating member placeable on the surface of water in the pool adjacent to and upstream of a water circulation drain of the pool. Attached to the floating member is a net immersed in the water for collecting debris in the proximity of the surface of the water in the pool. The floating member is preferably tethered to the side of the pool so as to be easily removable at predetermined intervals for dumping the debris from the net.

g.) U.S. Pat. No. 3,931,740, to Carter, is directed to an apparatus for sampling and collecting floating particulate matter on the surface of a body of water. The apparatus has parallel, laterally-spaced, longitudinal tracking floats supporting a rigid tubular frame. Secured to the frame are two parallel, hydrofoil bodies spaced apart from each other to form an intake opening.

A funnel-shaped net with its wide end secured to the intake opening and its narrow end terminating in a collecting screen collects surface particulate matter which is caused to flow into the intake opening as the apparatus is towed on a body of water. The lower hydrofoil body maintains the intake opening at a predetermined depth below the water surface, while the upper hydrofoil body enables the apparatus to ride over swells. In an alternative embodiment, a canvas sail is disposed above said net to form an air capturing pouch which provides a lifting force to lift and maintain the net in an attitude generally parallel to the water surface. This attitude maintenance permits the skimming of a relatively thin layer of surface water and floating matter from the bulk water below.

Though the foregoing patents offer different solutions to manual and automatic means for the removal of debris from a swimming pool, none present a simple and effective manual means, incorporating buoyancy elements, to skim the debris, such as leaves and the like, from the surface of a pool. The manner by which the present invention meets the challenges of such effective means will become more apparent in the description which follows.

SUMMARY OF THE INVENTION

This invention relates to a buoyant, pool skimming device for removing floating debris from the surface and subsurface of swimming pools. The device comprises a skimmer frame member having a continuous tubular ring, preferably filled with a light weight foam, supporting a water pervious net and an arm extending from the tubular ring for manually moving the tubular ring. For mounting on the tubular ring are plural flotation, buoyancy members removably secured to the tubular ring. The buoyancy members each comprise an elongated, elastomeric member having a longitudinal channel with a light weight foam body secured thereabout. The elastomeric member is shaped to complement the shape of the tubular ring for snap engagement therewith.

Accordingly, an object of this invention is the provision of an effective, yet simple, pool skimming device that incorporates plural buoyancy elements to facilitate manual movement of the device about the pool.

Another object hereof lies in the use of plural buoyancy elements that readily snap engage onto the device, or quickly removed for cleaning the pool bottom.

These and other objects will become more apparent, particularly those skilled in the art, from the following description and drawings.

DETAILED DESCRIPTION OF PREFERRED EMBODIMENT

Figure 1:
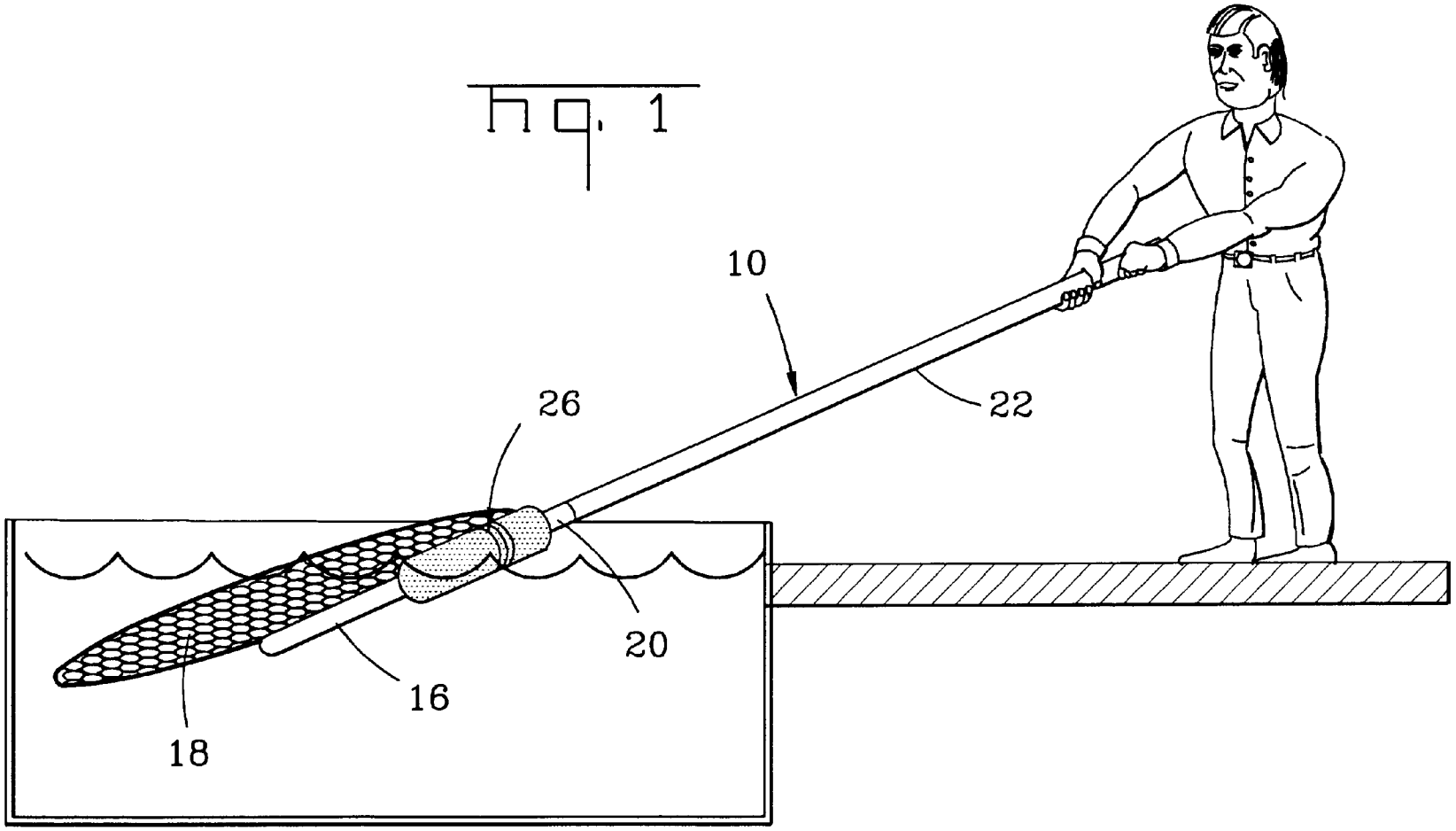
FIG. 1 is a side elevational view illustrating a swimming pool and a user operating the pool skimming device of this invention.

The present invention is directed to a pool skimming device having plural buoyancy members removably secured to the frame of the skimming device. The device will now be described with regard to the several Figures, where like reference numerals represent like components or features throughout the various views.

Figures 2, 3, 4:
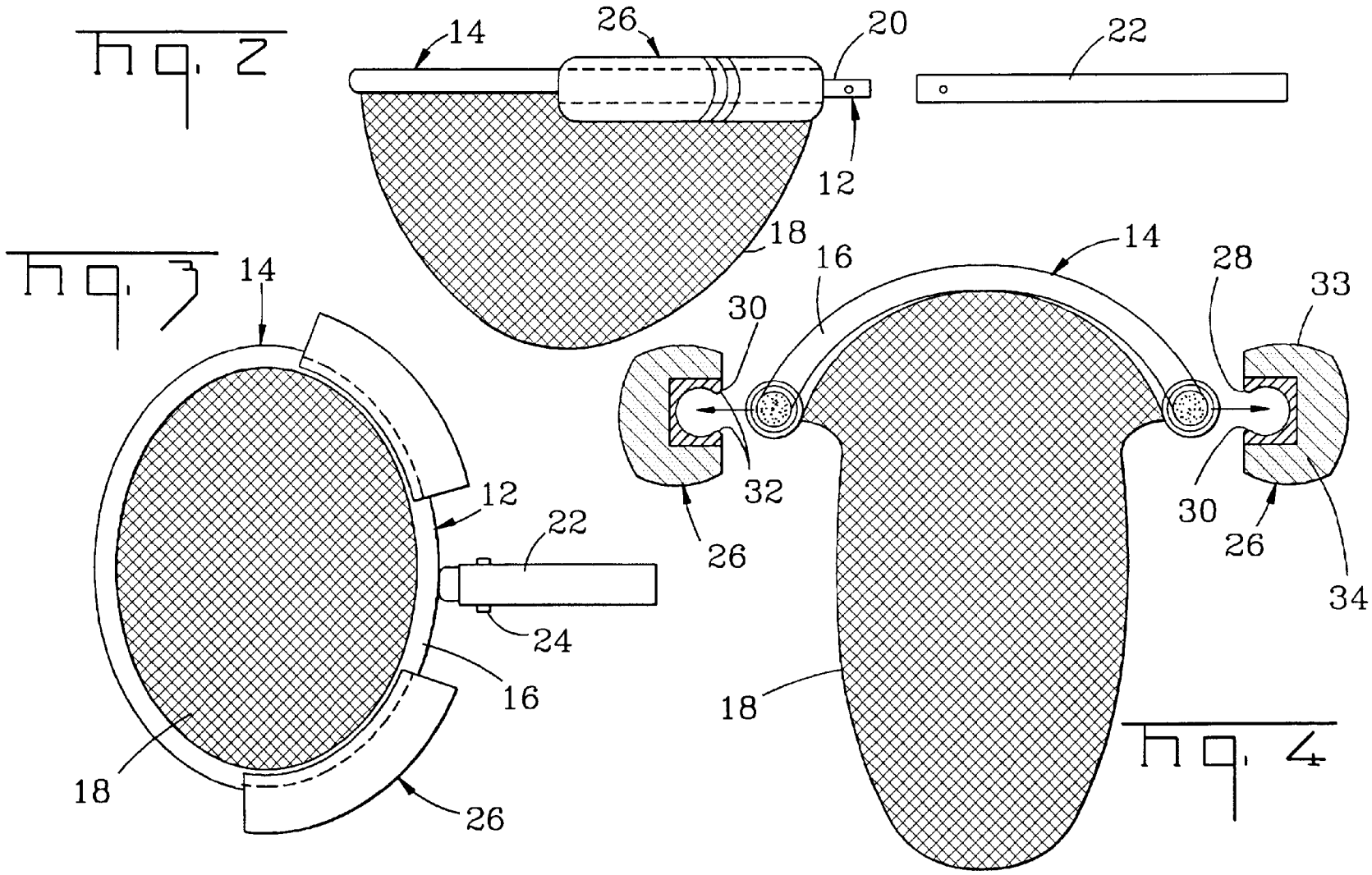
FIG. 2 is an exploded side view of the device hereof.
FIG. 3 is a top view of the pool skimming device of the invention.
FIG. 4 is an exploded front view, partially sectioned, showing the skimming net and a pair of unattached buoyancy members for the device hereof.

Turning now to the several Figures, FIG. 1 shows the skimming device 10 as it is manually manipulated by a user in removing debris from the surface and subsurface of a swimming pool. FIGS. 2–4 illustrate details of the skimming device 10 according to the present invention.

The device 10 comprises an elongated member 12 consisting of a continuous frame portion 14, see FIG. 3, formed by a tubular ring 16, such as aluminum or plastic, preferably filled with a foam like composition, as known in the art, to provide additional buoyancy to the device. Mounted within the ring 16 is a pervious net 18 to allow for moving through the water and picking up only the debris. Additional, the ring 16 includes a bracket 20 for removably securing a handle 22, with a spring biased pin member 24, as known in the art, see FIGS. 2 and 3.

To provide the desired buoyancy to the device 10 hereof, plural buoyancy members 26, preferably two in number, are removably secured to the tubular ring 16. As best seen in FIG. 2, the plural members 26 comprise an inner channel member 28, such as formed of rubber or an elastomeric material to be easily shaped to be removably attached to the tubular ring 16. Basically, the channel member 28 is C-configured having a opened face 30 featuring opposing nips 32 that facilitate flexing and closing about the tubular ring 16. The three remaining sides of the channel member 28 are covered by a light weight buoyancy body 33, such as a foam-like material 34, where the density thereof is less than water, see FIG. 4 showing sectional views of the buoyancy members 26 poised for removable attachment to the tubular ring 16.

It is recognized that variations, changes and modifications may be made to the skimmer device of the invention, particularly by those skilled in the art. Accordingly, no limitation is intended to be imposed thereon except as set forth in the accompanying claims.

What is claimed is:

1. A buoyant, pool skimming device for removing floating debris from the surface of a pool, said device comprising:

a.) a skimmer frame member having a continuous tubular ring supporting a water pervious net and an arm extending from said tubular ring for manually moving said tubular ring; and b.) plural flotation, buoyancy members for removably securing to said tubular ring, said buoyancy members comprising an elongated elastomeric member having a longitudinal channel with a light weight foam body secured thereabout, where said elastomeric member is complementary shaped for snap engaging to said tubular ring.

2. The buoyant, pool skimming device according to claim 1, wherein said elastomeric member is C-shaped.

3. The buoyant pool skimming device according to claim 2, wherein said foam body is secured about three sides of said elastomeric member.

4. The buoyant pool skimming device according to claim 1, wherein there are two buoyancy members, one on each side of said arm.

5. The buoyant pool skimming device according to claim 1, wherein said tubular ring includes a light weight foam to provide added buoyancy to said device.

6. The buoyant pool skimming device according to claim 1, wherein said tubular ring is generally circular and said buoyancy members are shaped to fit thereon.

* * * * *